US006824392B1

(12) United States Patent
Guo

(10) Patent No.: US 6,824,392 B1
(45) Date of Patent: Nov. 30, 2004

(54) RCA CONNECTOR CAPABLE OF BEING INSERTED INTO CIRCUIT BOARD DIRECTLY

(76) Inventor: Pony Guo, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/696,672

(22) Filed: Oct. 27, 2003

(51) Int. Cl.[7] ..... H01R 12/00

(52) U.S. Cl. ..... 439/63; 439/607; 439/581; 439/675; 439/322; 439/578; 439/126

(58) Field of Search ..... 439/63, 607–609, 439/581, 322, 578–585, 126

(56) References Cited

U.S. PATENT DOCUMENTS 5,215,470 A * 6/1993 Henry et al. ..... 439/63
5,897,384 A * 4/1999 Hosler, Sr. ..... 439/63
6,053,743 A * 4/2000 Mitchell et al. ..... 439/63
6,113,397 A * 9/2000 Myers ..... 439/63
6,116,914 A * 9/2000 Koide ..... 439/63
6,257,924 B1 * 7/2001 Lund et al. ..... 439/541.5
6,663,397 B1 * 12/2003 Lin et al. ..... 439/63
6,719,586 B2 * 4/2004 Weidner ..... 439/581

* cited by examiner

*Primary Examiner*—Truc T. T. Nguyen

(57) ABSTRACT

An RCA connector capable of being inserted into a circuit board directly comprises a joint and a cover. One end of the joint has a protruded annular wall. A center of the annular wall has a metal lead. The metal lead passes through a notch of the annular wall by using a conductive medium. The cover covers on the annular wall; and the cover has an opening corresponding to the notch of the annular wall so that the conductive medium extends out from the opening of the cover. Further, a lower end of the annular wall is firmly secured to a retaining seat. A plurality of positioning pins are extended from the retaining seat so that the RCA connector is fixed to a mother board by the positioning pins. Moreover, the metal enhancing plate and the conductive lead can be replaced by an L shape long metal lead.

20 Claims, 5 Drawing Sheets

RCA CONNECTOR CAPABLE OF BEING INSERTED INTO CIRCUIT BOARD DIRECTLY

FIELD OF THE INVENTION

The present invention relates to electric connectors, and particular to an RCA connector which is suitable to be inserted into a circuit board directly. The connector is used to the signal processing of electronic, communicational and electric devices, such as notebook computers, bluetooth products, desk-top computers, etc for reducing electromagnetic interference so as to has a preferred signal quality.

BACKGROUND OF THE INVENTION

With the improvement of technology, current notebook computers have function of inputting video signals. The notebook computer is capable of being connected with a video coaxial cable for viewing video programs. Furthermore, bluetooth wireless communication products need coaxial cables for transmitting signals. The prior art RCA connector is a coaxial cable with a larger volume. One end of the RCA connector has an annular wall for protecting a metal lead. The annular wall is formed with a notch for passing through by a signal wire connected to the metal lead. Another end of the signal wire is connected to a video interface of a notebook computer.

However, the prior art RCA connector has a defect that the connection of the metal lead and the signal wire are exposed out. The metal lead and the signal wire are higher than the annular wall. The annular wall has two notches so that too much of the metal lead is exposed. Thus electromagnetic interference cannot be avoided. Thus, signals are easily interfered by electromagnetic waves from other electronic elements on the circuit board so as to affect the quality of signals.

Furthermore, the prior art RCA connector has a larger volume and thus it is not suitable to be used in high frequency product.

SUMMARY OF THE INVENTION

Accordingly, the primary object of the present invention is to provide a thread-connected RCA connector, wherein the electromagnetic interference can be reduced effectively so as to have preferred video quality. Further, the present invention can be made easily and the decay of the video signals is reduced.

To achieve above object, the present invention provides an RCA connector capable of being inserted into a circuit board directly. The RCA connector comprises a joint and a cover. One end of the joint has a protruded annular wall. A center of the annular wall has a metal lead. The metal lead passes through a notch of the annular wall by using a conductive medium. The cover covers on the annular wall; and the cover has an opening corresponding to the notch of the annular wall so that the conductive medium extends out from the opening of the cover. Further, a lower end of the annular wall is firmly secured to a retaining seat. A plurality of positioning pins are extended from the retaining seat so that the RCA connector is fixed to a mother board by the positioning pins.

In above description, the metal lead can be replaced by an L shape long metal lead which passes through the notch of the annular wall and the opening of the cover so as to be fixed to a mother board.

Moreover, the metal lead is a short metal lead and the conductive medium is a signal wire. When the signal wire passes through the opening of the cover, the signal wire is connected to a video interface.

A height of the metal lead is higher than that of the annular wall.

The notch of the annular wall is a through hole.

The retaining seat has three positioning pins which extend from two bending plates at two lateral sides of the retaining seat and a bottom side of the retaining seat, respectively.

A periphery of the cover is enclosed by a U shape enhancing block for fixing two bending plates at two lateral sides of the retaining seat.

A center of the enhancing block has a through hole.

Two sides of the enhancing block have respective long slots for fixing two nose portions protruded from the two bending plates.

An opening of the cover has tip portions for positioning the enhancing block.

An upper end of the retaining seat has a bending plate.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

First Embodiment

Figure 1:
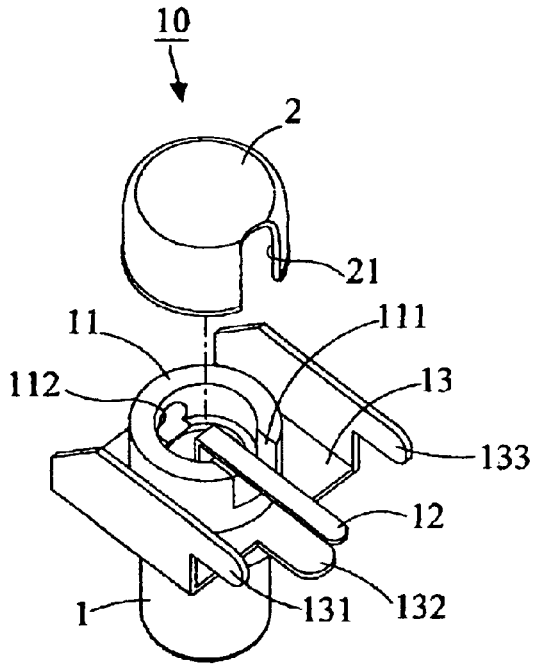
FIG. 1 is an exploded perspective view of the first embodiment of the present invention.
Figure 2:
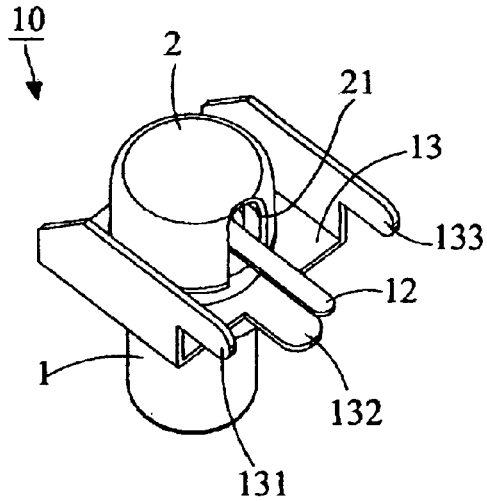
FIG. 2 is an assembled perspective view of the first embodiment of the present invention.

With reference to FIGS. 1 and 2, the exploded perspective view and assembled view of the first embodiment of the RCA connector 10 of the present invention are illustrated. The RCA connector 10 according to the present invention includes a joint 1 and a cover 2. One end of the joint 1 has an annular wall 11. A center of the joint 1 is protruded from the annular wall 11. A center of the annular wall 11 has an L shape long metal lead 12. The L shape long metal lead 12 has an L shape and a height of the mother board 3 is lower than that of the annular wall 11. The L shape long metal lead 12 is used as a conduction medium. A length of the L shape long metal lead 12 extends out of a notch 111 of the annular wall 11. The cover 2 covers the annular wall 11 so as to enclose the annular wall 11. Only an opening 21 of the cover 2 is left to be correspondent to the notch 111 of the annular wall 11. The cover 2 shields the annular wall 11 so as to reduce the interference of electromagnetic waves and noises.

Figure 3:
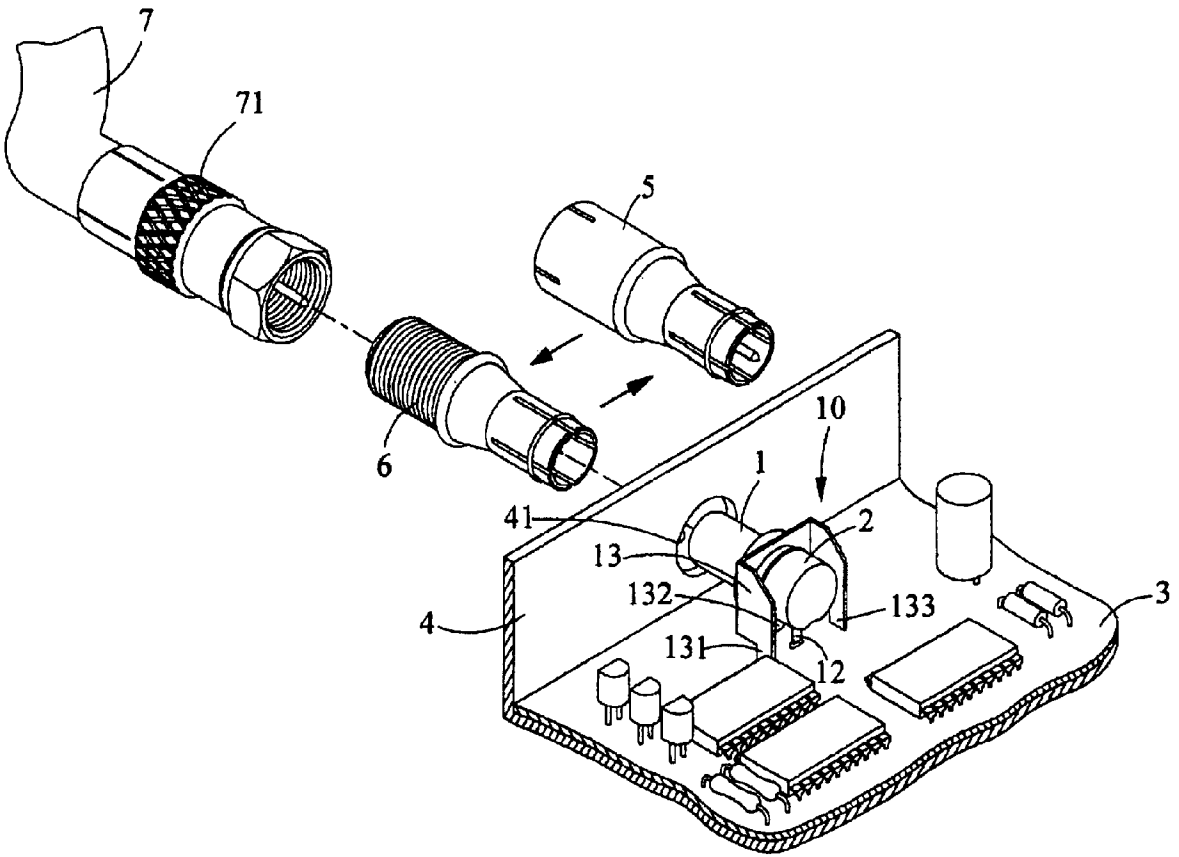
FIG. 3 is a schematic view showing the application of the first embodiment of the present invention.

Moreover, a lower side of the annular wall 11 has a retaining seat 13. Two sides of the retaining seat 13 are bent to form two bending plates 13*a* and 13*c*. The positioning pins 131, 133, 132 are extended from the two bending plates 13*a*, 13*c* and a bottom plate 13*b*, respectively. The extending direction of the positioning pins 131, 132, 133 are the same as that of the L shape long metal lead 12. The positioning pins 131 to 133 can be inserted into a mother board 3 for positioning the RCA connector 10 to the mother board 3, as shown in FIG. 3.

Further, the L shape long metal lead 12 is corresponding to the video input circuit of the mother board 3 and the two are fixed by welding. Next, another end of the joint 1 is correspondent to an insertion hole 41 of a notebook computer casing 4. Then the joint 1 is able to be connected with a PAL signal adaptor 5 (specification used in U.S.) or a NTSC signal adaptor 6 (specification used in Japan). Then the PAL signal adaptor 5 or the NTSC signal adaptor 6 is connected to a joint 71 of a video coaxial cable 7 so that the notebook computer can input video signals of different specifications.

Second Embodiment

Figure 4:
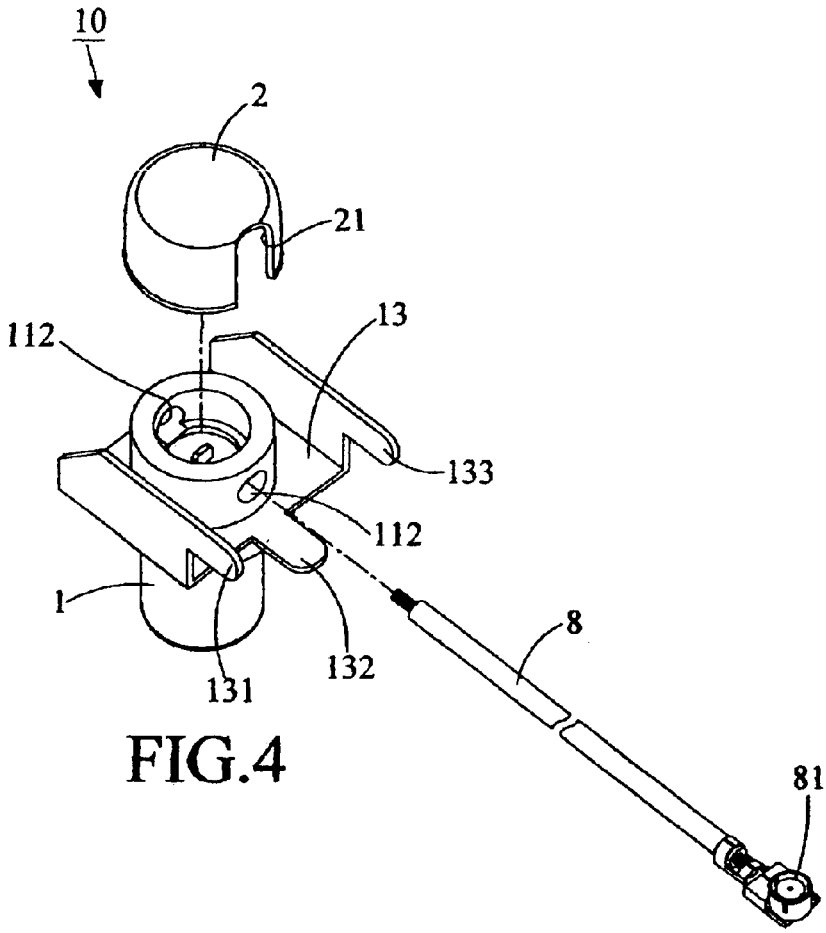
FIG. 4 is an exploded perspective view of the second embodiment of the present invention.
Figure 5:
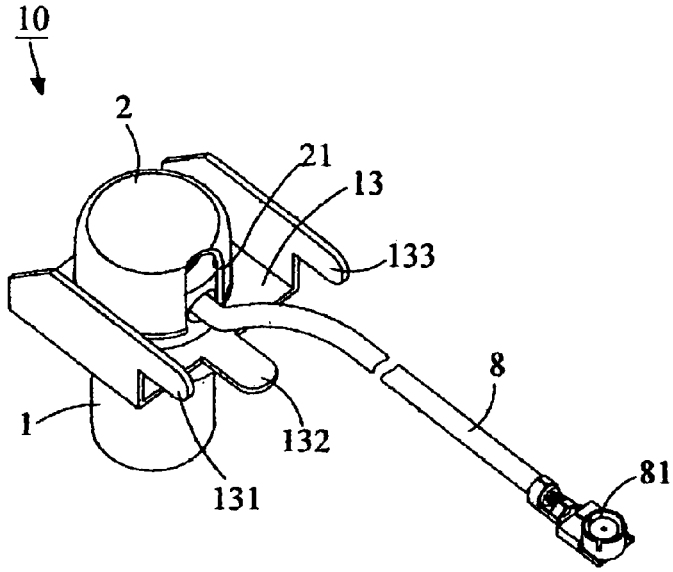
FIG. 5 is an assembled perspective view of the second embodiment of the present invention.

With reference to FIGS. 4 and 5, the exploded perspective view and assembled view about the second embodiment of the RCA connector 10 of the present invention are illustrated. It is illustrated that the RCA connector 10 is still formed by a joint 1 and a cover 2. The structure of this embodiment is the same as that of the first embodiment except that the a metal lead 14 is at a center of the annular wall 11, but the metal lead 14 is a short lead instead of L shape metal lead. The height of the metal lead 14 is lower than that of the annular wall 11. The metal lead 14 is integrally welded to the signal wire 8 so that the signal wire 8 is as a conductive medium. One end of the signal wire 8 passes through the through hole 112 of the annular wall 11 and the opening 21 of the cover 2. Then a joint 81 at another end is connected to a video interface 82, as shown in FIG. 6.

Figure 6:
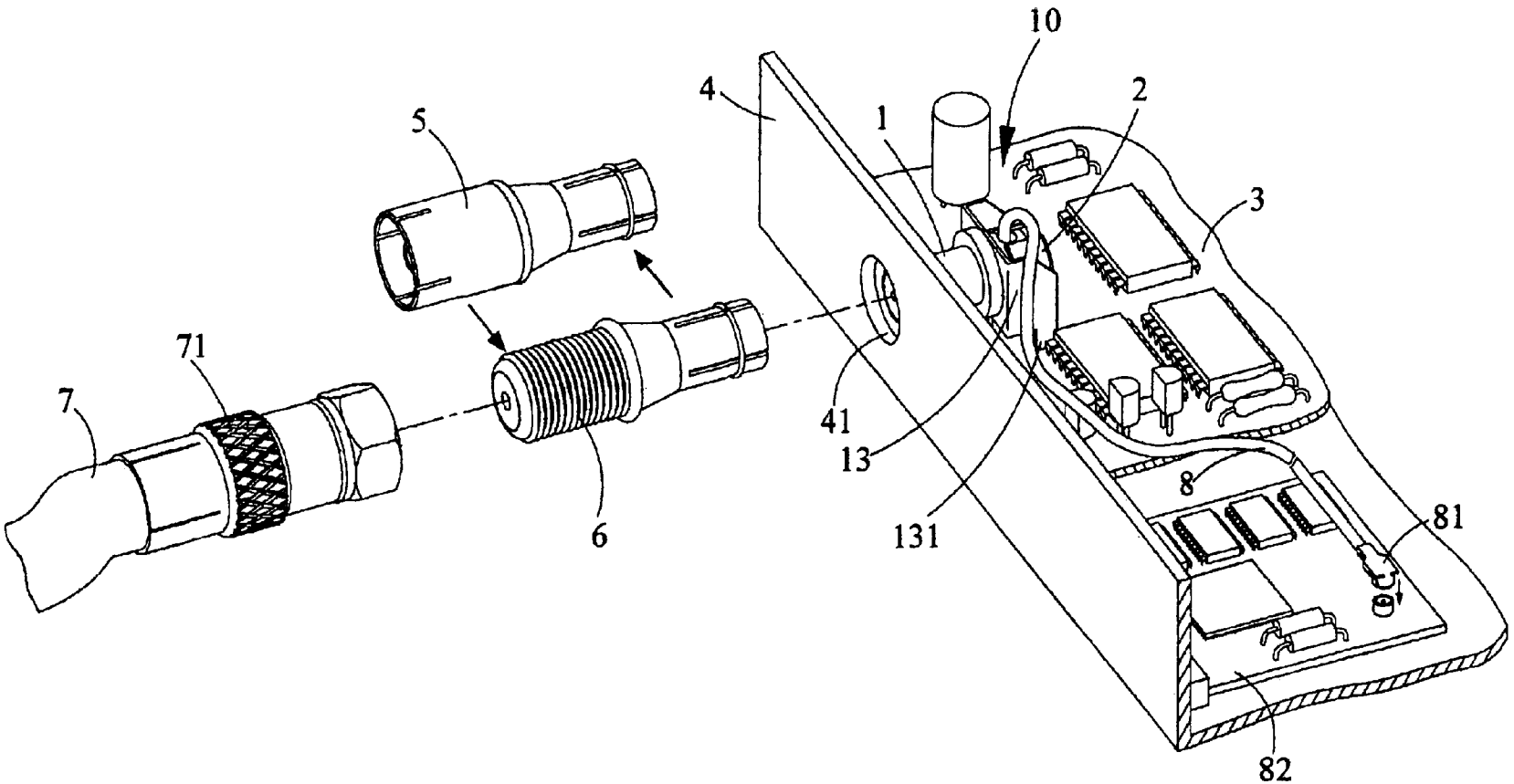
FIG. 6 is a schematic view showing the application of the third embodiment of the present invention.

In FIG. 6, when the signal wire 8 is realized, the signal wire 8 (being a 75 ohm wire) is flexible so that it is bendable. Thus, the signal wire 8 is not affected by the finite space of the notebook computer and thus it is suitable to be connected to a video interface 82.

Therefore, from above description, it is known that when the L shape long metal lead 12 illustrated in the first embodiment is not suitable, the L shape long metal lead 12 is replaced by the short metal lead as illustrated in second embodiment. Then the short metal lead 14 is connected to the signal wire 8. Thereby, the through holes 112 of the annular wall 11 in the first embodiment are used for this usage. In the second embodiment, maybe there are two through holes 112 in the second embodiment, which are oppositely and symmetrically arranged on the annular wall 11. The signal wire 8 extends out of the upper side of the lower side of the RCA connector 10.

Third Embodiment

Figure 7:
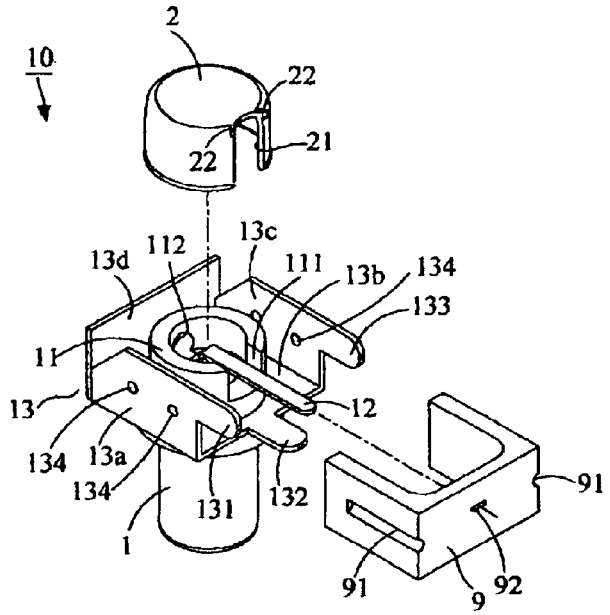
FIG. 7 is an exploded perspective view of the third embodiment of the present invention.
Figure 8:
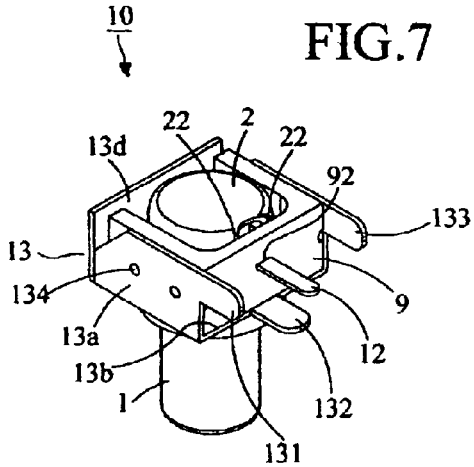
FIG. 8 is an assembled perspective view of the third embodiment of the present invention.

With reference to FIGS. 7 and 8, the exploded perspective view and assembled view of the RCA connector 10 in the third embodiment of the present invention are illustrated. It is illustrated that the RCA connector 10 is formed by a joint 1, a cover 2 and an enhancing block 9. The joint 1 and cover 2 have structures like those described in the first embodiment except that the enhancing block 9 is a U shape plastic block and is installed at a periphery of the cover 2. The outer surface of the cover 2 has tow tip portions 22 for positioning the enhancing block 9 for fixing the two bending plates 13*a* and 13*b* at two lateral sides. Thereby, the two positioning pins 131 and 133 will not shift or displace due to the outer applied forces. Besides, two sides of the enhancing block 9 have respective long slots 91 for enhancing the structure and for being embedded by nose portions 134 at the bending plates 13*a* and 13*c*. A center of the enhancing block 9 has a through hole 92 so that the L shape long metal lead 12 can pass through the through hole 92. Furthermore, the L shape long metal lead 12 can be firmly secured.

Moreover, the retaining seat 13 of the joint 1 has a bending plate 13*d* for being absorbed by a mechanic arm so that it can be inserted to a mother board 3 and then the mechanic arm leaves the connector.

Fourth Embodiment

Figure 9:
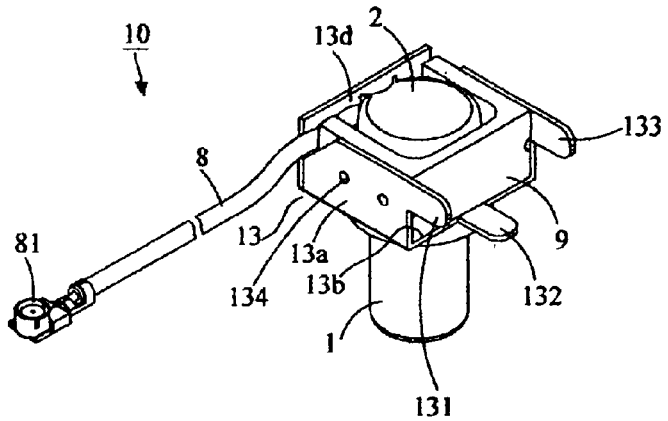
FIG. 9 is a schematic view showing the application of third embodiment of the present invention.

With reference to FIG. 9, an assembled perspective view of the RCA connector 10 in the fourth embodiment of the present invention is illustrated. It is illustrated that the structure of the RCA connector 10 in this embodiment is like that of the third embodiment except that the L shape long metal lead 12 is not used. Only the signal wire 8 is used. That construction is like that in the second embodiment and thus the details will not be further described here.

Advantages of the present invention are that the electromagnetic interference can be reduced so as to have a preferred video quality and has a lower power lose. Moreover, the RCA connector of the present invention is compact and can be made easily. Further the decay of the RCA connector of the present invention is low.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An RCA connector capable of being inserted into a circuit board directly; the RCA connector comprising a joint and a cover; wherein one end of the joint has a protruded annular wall; a center of the annular wall has a metal lead; the metal lead passes through a notch of the annular wall by using a conductive medium; the cover covers on the annular wall; and the cover has an opening corresponding to the notch of the annular wall so that the conductive medium extends out from the opening of the cover; further, a lower end of the annular wall is firmly secured to a retaining seat; a plurality of positioning pins are extended from the retaining seat so that the RCA connector is fixed to a mother board by the positioning pins.

2. The RCA connector as claimed in claim the metal lead is a short metal lead and the conductive medium is a signal wire; when the signal wire passes through the opening of the cover, the signal wire is connected to a video interface.

3. The RCA connector as claimed in claim 1, wherein a height of the metal lead is higher than that of the annular wall.

4. The RCA connector as claimed in claim 1, wherein the notch of the annular wall is a through hole.

5. The RCA connector as claimed in claim 1, wherein the retaining seat has three positioning pins which extend from two bending plates at two lateral sides of the retaining seat and a bottom side of the retaining seat, respectively.

6. The RCA connector as claimed in claim 1, wherein a periphery of the cover is enclosed by a U shape enhancing block for fixing two bending plates at two lateral sides of the retaining seat.

7. The RCA connector as claimed in claim 6, wherein a center of the enhancing block has a through hole.

8. The RCA connector as claimed in claim 1, wherein two sides of the enhancing block have respective long slots for fixing two nose portions protruded from the two bending plates.

9. The RCA connector as claimed in claim 6, wherein an opening of the cover has tip portions for positioning the enhancing block.

10. The RCA connector as claimed in claim 6, wherein an upper end of the retaining seat has a bending plate.

11. An RCA connector; the RCA connector comprising a joint and a cover; wherein one end of the joint has a protruded annular wall; a center of the annular wall has a metal lead; metal lead is an L shape long metal lead which extends out of the notch of the annular wall; the cover covers on the annular wall; and the cover has an opening corresponding to the notch of the annular wall so that the metal lead further extends out of the opening of the cover; further, a lower end of the annular wall is firmly secured to a retaining seat; a plurality of positioning pins are extended from the retaining seat so that the RCA connector is fixed to a mother board by the positioning pins.

12. The RCA connector as claimed in claim 11, wherein the L shape long metal lead is fixed to a mother board.

13. The RCA connector as claimed in claim 1, wherein a height of the metal lead is higher than that of the annular wall.

14. The RCA connector as claimed in claim 1, wherein the notch of the annular wall is a through hole.

15. The RCA connector as claimed in claim 1, wherein the retaining seat has three positioning pins which extend from two bending plates at two lateral sides of the retaining seat and a bottom side of the retaining seat, respectively.

16. The RCA connector as claimed in claim 1, wherein a periphery of the cover is enclosed by a U shape enhancing block for fixing two bending plates at two lateral sides of the retaining seat.

17. The RCA connector as claimed in claim 6, wherein a center of the enhancing block has a through hole.

18. The RCA connector as claimed in claim 1, wherein two sides of the enhancing block have respective long slots for fixing two nose portions protruded from the two bending plates.

19. The RCA connector as claimed in claim 6, wherein an opening of the cover has tip portions for positioning the enhancing block.

20. The RCA connector as claimed in claim 6, wherein an upper end of the retaining seat has a bending plate.

* * * * *